US009850617B2

(12) United States Patent
Huang et al.

(10) Patent No.: US 9,850,617 B2
(45) Date of Patent: Dec. 26, 2017

(54) FRONT-LOADING WASHING MACHINE

(71) Applicant: WUXI LITTLE SWAN CO., LTD., Wuxi (CN)

(72) Inventors: Mingde Huang, Wuxi (CN); Yusheng Tang, Wuxi (CN); Kyunghag Kim, Wuxi (CN)

(73) Assignee: WUXI LITTLE SWAN CO., LTD., Wuxi (CN)

( * ) Notice: Subject to any disclaimer, the term of this patent is extended or adjusted under 35 U.S.C. 154(b) by 0 days.

(21) Appl. No.: 15/340,267

(22) Filed: Nov. 1, 2016

(65) Prior Publication Data

US 2017/0218556 A1 Aug. 3, 2017

(30) Foreign Application Priority Data

Jan. 28, 2016 (CN) ..... 2016 1 0059066
Jan. 28, 2016 (CN) ..... 2016 2 0086082 U

(51) Int. Cl.
*D06F 37/30* (2006.01)
*D06F 33/02* (2006.01)
*D06F 37/04* (2006.01)

(52) U.S. Cl.
CPC ..... *D06F 37/30* (2013.01); *D06F 33/02* (2013.01); *D06F 37/04* (2013.01); *D06F 37/304* (2013.01); *D06F 37/302* (2013.01)

(58) Field of Classification Search
None
See application file for complete search history.

(56) References Cited

U.S. PATENT DOCUMENTS 5,442,937 A * 8/1995 Kwon ..... D06F 23/00 68/12.27
2003/0033963 A1* 2/2003 Doyle ..... A47B 9/04 108/147.19
2012/0042697 A1* 2/2012 Hong ..... D06F 33/02 68/12.23
2012/0184401 A1* 7/2012 Shepherd ..... A63B 63/083 473/481

* cited by examiner

*Primary Examiner* — Jason Ko
*Assistant Examiner* — Spencer Bell
(74) *Attorney, Agent, or Firm* — Hodgson Russ LLP

(57) ABSTRACT

Provided is a front-loading washing machine including a cabinet having a front panel, in which the front panel is provided with an opening; a tub having an access port for loading and unloading laundry, in which the tub is disposed in the cabinet and configured in such a manner that the access port is capable of being moved up and down in the opening; a rotatable drum, disposed in the tub; a door unit, mounted to the tub, and configured to cover the access port; and a driving mechanism configured to drive the tub to rotate, in which the driving mechanism is provided in the cabinet and coupled to the tub. The front-loading washing machine according to embodiments of the present disclosure has advantages of user-friendliness, little abrasion clothes and water conservation.

8 Claims, 4 Drawing Sheets

FRONT-LOADING WASHING MACHINE

CROSS-REFERENCE TO RELATED APPLICATION

This application claims priority to and benefits of Chinese Patent Application Serial No. 201610059066.7 filed with the State Intellectual Property Office of P. R. China on Jan. 28, 2016 and Chinese Patent Application Serial No. 201620086082.0 filed with the State Intellectual Property Office of P. R. China on Jan. 28, 2016, the entire contents of which are incorporated herein by reference.

FIELD

The present disclosure relates to a technical field of household appliances, and more particularly to a front-loading washing machine.

BACKGROUND

In the related art, a washing machine includes a front-loading washing machine and a pulsator type washing machine. When a pulsator type washing machine is used for washing clothes, the clothes need to be fully soaked in water, so the pulsator type washing machine is poor in water conservation. A user has to stoop and crouch for putting the clothes in or fetching them out when using the front-loading washing machine, so the front-loading washing machine is very inconvenient to use, particularly difficult for elderly people and other special populations to operate.

SUMMARY

The present disclosure seeks to solve at least one of the problems existing in the related art to at least some extent. Therefore, the present disclosure provides a front-loading washing machine which has advantages of user-friendliness, little clothes abrasion and water conservation.

The front-loading washing machine according to embodiments of the present disclosure includes a cabinet, having a front panel with an opening formed therein; a tub is disposed in the cabinet and configured in such a manner that the access port is capable of being moved up and down in the opening; a rotatable drum, disposed in the tub; a door unit, mounted to the tub, and configured to cover the access port; and a driving mechanism configured to drive the tub to rotate, in which the driving mechanism is provided in the cabinet and coupled to the tub.

The front-loading washing machine according to embodiments of the present disclosure has advantages of user-friendliness, little clothes abrasion and water conservation.

In addition, the front-loading washing machine according to the embodiments of the present disclosure may further have following additional technical features.

According to some embodiments of the present disclosure, the driving mechanism drives the access port to move up and down between a non-washing-state position and a washing-state position in the opening.

According to some embodiments of the present disclosure, when the access port is located at the non-washing-state position, the access port is driven to move to approach an upper edge of the front panel; and when the access port is located at the washing-state position, the access port is driven to move to approach a lower edge of the front panel.

According to some embodiments of the present disclosure, the driving mechanism is configured to drive the access port to move upwards to approach the upper edge of the front panel and move downwards to approach the lower edge of the front panel.

According to some embodiments of the present disclosure, when the access port is located at the non-washing-state position, an included angle between a central axis of the access port and a horizontal plane is 45 degrees to 90 degrees; and when the access port is located at the washing-state position, the included angle between the central axis of the access port and the horizontal plane is 0 degree to 15 degrees.

According to some embodiments of the present disclosure, the driving mechanism includes a longitudinal pushrod disposed at a front side of the tub, a transverse shaft disposed at a rear side of the tub and coupled with the tub, and a support frame disposed to the cabinet and having a hole, in which the transverse shaft rotates in the hole of the support frame.

According to some embodiments of the present disclosure, the front-loading washing machine further includes a controller communicating with the driving mechanism, when the front-loading washing machine starts operating, the controller controls the driving mechanism to drive the access port to move downwards; and when the front-loading washing machine stops operating, the controller controls the driving mechanism to drive the access port to move upwards.

According to some embodiments of the present disclosure, the controller controls the driving mechanism to drive the access port to move upwards or downwards by controlling positive and negative of a direct current input to the driving mechanism.

According to some embodiments of the present disclosure, the controller includes a first relay and a second relay, the first relay controls conduction and turn-off of the direct current input to the driving mechanism, and the second relay controls the positive and negative of the direct current input to the driving mechanism.

According to some embodiments of the present disclosure, when the first relay is closed and the second relay is disconnected, the driving mechanism drives the access port to move upwards; and when the first relay is closed and the second relay is closed, the driving mechanism drives the access port to move downwards.

According to some embodiments of the present disclosure, maximum one-way time for the driving mechanism to drive the access port to move upwards or downwards is a pre-determined adjustable time.

According to some embodiments of the present disclosure, after the front-loading washing machine is powered and before operating, the first relay is closed for the pre-determined adjustable time and the second relay is disconnected; when the front-loading washing machine starts operating, the second relay is closed before the first relay, and the first relay and the second relay are closed for the pre-determined adjustable time simultaneously; and when the front-loading washing machine stops operating, the first relay is closed for the pre-determined adjustable time and the second relay is disconnected.

Additional aspects and advantages of the present disclosure will be given in part in the following descriptions, become apparent in part from the following descriptions, or be learned from the practice of the present disclosure.

Figure 1:
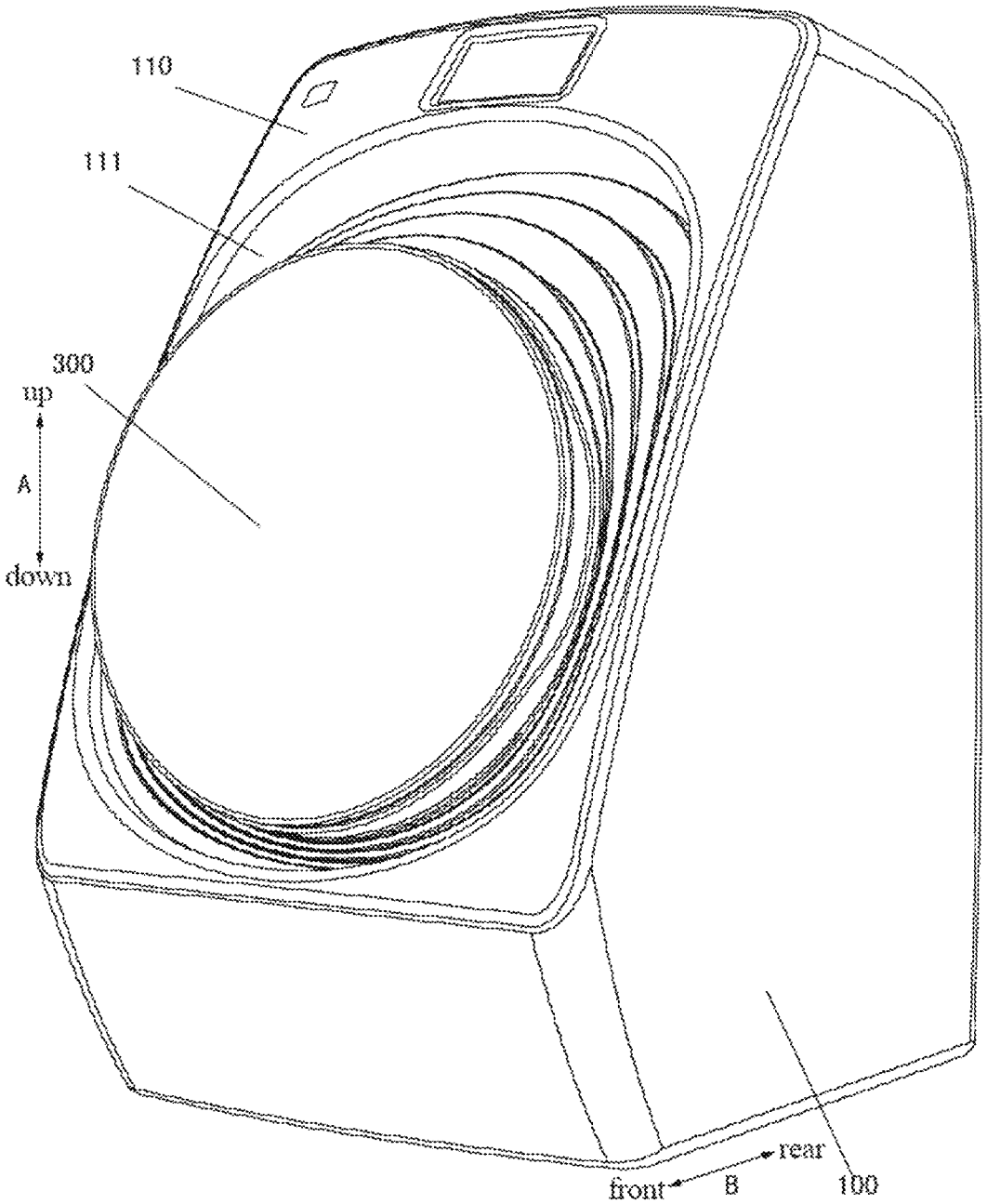
FIG. 1 is a schematic view of a front-loading washing machine according to an embodiment of the present disclosure, in which an access port is located at a washing-state position.

REFERENCE NUMERALS front-loading washing machine 1:

cabinet 100; front panel 110; opening 111; tub 200; door unit 300; driving mechanism 400; longitudinal pushrod 410; transverse shaft 420; support frame 430; hole 431;

DETAILED DESCRIPTION

Reference will be made in detail to embodiments of the present disclosure. Examples of the embodiments are shown in the drawings. The embodiments described herein with reference to drawings are explanatory, and used to generally understand the present disclosure, and shall not be construed to limit the present disclosure.

In the following, a front-loading washing machine 1 according to embodiments of the present disclosure will be described with reference to the drawings.

As shown in FIG. 1 to FIG. 4, the front-loading washing machine 1 according to the embodiments of the present disclosure may include a cabinet 100, a tub 200, a rotatable drum (not shown in the figures), a door unit 300 and a driving mechanism 400.

The cabinet 100 has a front panel 110 (a front-and-rear direction as indicated by arrow B in FIG. 1 to FIG. 3), and the front panel 110 has an opening 111 formed therein. The tub 200 has the access port, and tub 200 is disposed in the cabinet 100 and configured in such a manner that the access port is capable of being moved up and down (an up-and-down direction as indicated by arrow A in FIG. 1 to FIG. 3) in the opening 111. The drum is disposed in the tub 200. The door unit 300 is mounted to the tub 200 and covers the access port. The driving mechanism 400 is used for driving the tub 200 to move, and the driving mechanism 400 is configured in the cabinet 100 and coupled with the tub 200.

In the front-loading washing machine 1 according to the embodiments of the present disclosure, by means of that the tub 200 is configured in such a manner that the access port is capable of being moved up and down in the opening 111, compared with a front-loading washing machine having an access port fixedly disposed in a front surface in the related art, the front-loading washing machine 1 can make the access port move to a suitable position for a user to put clothes in or take clothes out when the user is putting clothes in or taking clothes out. For example, the access port can be made to move upwards. In such a way, the user does not need to stoop or crouch when putting clothes in or taking clothes out, which not only is convenient for the user to put clothes in or take clothes out through the access port, but also makes people who cannot stoop easily, for example, the elderly put clothes in or take clothes out smoothly, thus improving convenience of the washing machine.

Furthermore, as the access port may move up and down in the opening 111, the access port can be moved to a position suitable for washing clothes after the clothes are put in. For example, the access port can be made to move downwards. In the process of washing the clothes, the drum can roll to drive the clothes to be beaten up and down so as to be washed, which not only reduces abrasion of the clothes, but also no longer needs to fully soak the clothes in water—instead, only needs a small amount of water for washing, thus reducing water consumption and facilitating environment protection.

In addition, the driving mechanism 400 is provided to drive the tub 200. The user can operate the driving mechanism 400 to drive the tub 200 when the user needs to adjust the position of the access port. Thus, the user can adjust the position of the tub 200 more effortlessly, 1) so as to facilitate adjustment of the position of the access port, further improving the convenience when users like the elderly use the washing machine 1, and 2) so that it is convenient for the user to adjust the position of the tub 200, and further for the user (such as the aged) to use the front-loading washing machine 1.

That is, in the washing machine 1, the tub 200 is configured in such a manner that the access port is capable of being moved up and down in the opening 111, and the driving mechanism 400 is provided to drive the tub 200 to move. In such a way, the washing machine 1 can not only achieve a washing effect as a common front-loading washing machine when washing clothes, but also adjust the access port to a suitable position for putting clothes in, taking clothes out, or adding clothes halfway, which overcomes the problem that clothes cannot be conveniently put into or taken out from the front-loading washing machine in the related art, so the washing machine 1 is easy for the user to use and convenient to mount.

Accordingly, the front-loading washing machine 1 according to the embodiments of the present disclosure has the advantages of user-friendliness, little clothes abrasion and water conservation.

In the following, the front-loading washing machine 1 according to specific embodiments of the present disclosure will be described with reference to the drawings.

Figure 2:
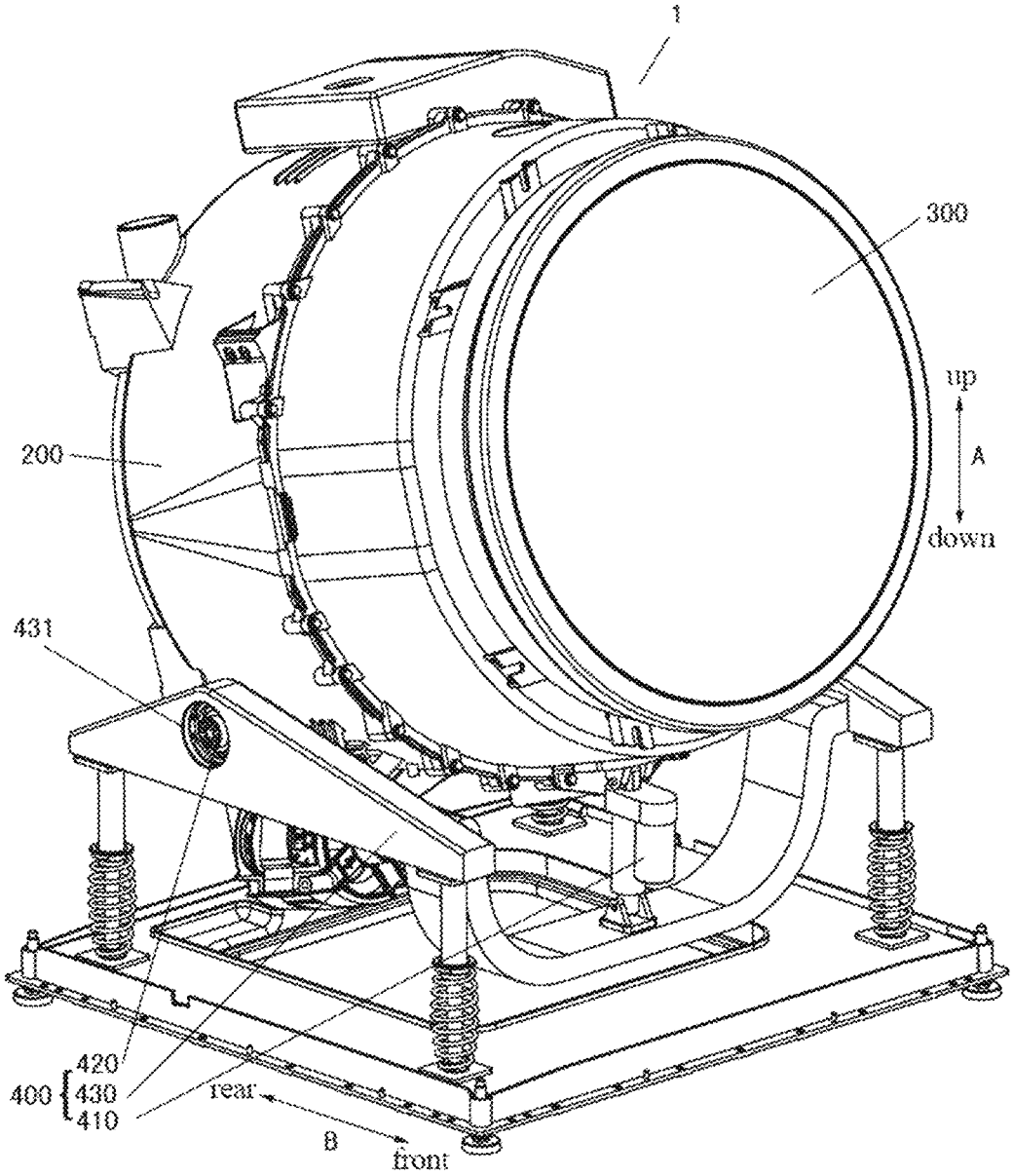
FIG. 2 is a partially schematic view of the front-loading washing machine according to the embodiment of the present disclosure, in which the access port is located at the washing-state position.
Figure 3:
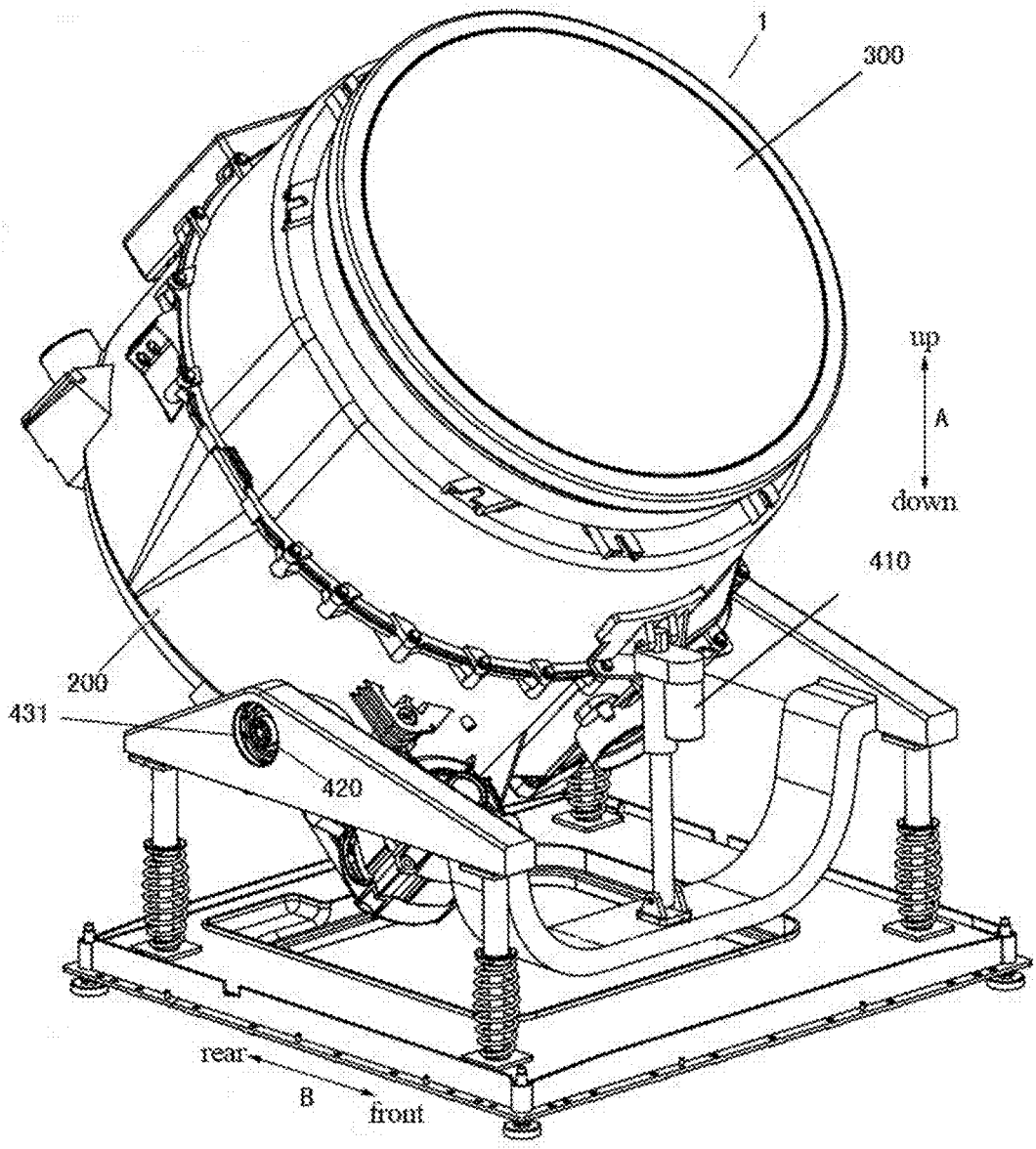
FIG. 3 is a partially schematic view of the front-loading washing machine according to the embodiment of the present disclosure, in which the access port is located at a non-washing-state position.

In some specific embodiments of the present disclosure, as shown in FIG. 1 to FIG. 3, the front-loading washing machine 1 according to the embodiments of the present disclosure includes the cabinet 100, the tub 200, the rotatable drum, the door unit 300 and the driving mechanism 400.

The driving mechanism 400 drives the access port to move up and down between a non-washing-state position and a washing-state position in the opening 111. Thus, the driving mechanism 400 can be used to drive the tub 200 to make the access port move to the washing-state position so as to wash clothes, when the clothes need washing; and the driving mechanism 400 can be used to drive the tub 200 to make the access port move to the non-washing-state position convenient for the user to put clothes in or take clothes out, when the clothes do not need washing.

In some preferable embodiments of the present disclosure, the front-loading washing machine 1 may further include a controller communicating with the driving mechanism 400. When the front-loading washing machine starts operating, the controller controls the driving mechanism 400 to drive the access port to move downwards; and when the front-loading washing machine stops operating, the controller controls the driving mechanism 400 to drive the access port to move upwards. Thus, the driving mechanism 400 can achieve an automatic control over the access port under the control of the controller without any manual operation, which is convenient to control and operate and has a higher automatic degree, easier to use and more effortless to operate.

Optionally, the controller may control the driving mechanism to drive the access port to move upwards or downwards by controlling positive and negative of a direct current input to the driving mechanism 400. That is, operating states of the driving mechanism are different when positive and negative direct currents are input to the driving mechanism, so the states of driving the access port to move are different, thus realizing an upward movement or a downward movement of the access port. For example, in a specific example of the present disclosure, when the direct current input to the driving mechanism 400 is positive, the driving mechanism 400 can rotate forward and drive the access port to move upwards; when the direct current input to the driving mechanism 400 is negative, the driving mechanism 400 then rotates reversely and drives the access port to move downwards. The controller has a good controlling performance and is convenient to apply.

According to some specific embodiments of the present disclosure, the controller may include a first relay and a second relay. The first relay controls conduction and turn-off of the direct current input to the driving mechanism 400, and the second relay controls the positive and negative of the direct current input to the driving mechanism 400. That is, the first relay may control whether the direct current is switched on in the driving mechanism 400, and the second relay may change the positive and negative condition of the direct current, which can achieve a control over the direct current input to the driving mechanism 400 conveniently and has a good control performance, and the product is easy to manufacture.

In a specific embodiment of the present disclosure, when the first relay is closed and the second relay is disconnected, the driving mechanism 400 may drive the access port to move upwards; and when the first relay is closed and the second relay is closed, the driving mechanism 400 may drive the access port to move downwards. That is, when the first relay is closed, the direct current may be turned on in the driving mechanism 400, and at that moment the second relay is disconnected, so the positive and negative condition of the direct current input to the driving mechanism 400 will not be changed, and the access port may move upwards driven by the driving mechanism 400; when the second relay is closed, the positive and negative condition of the direct current input to the driving mechanism 400 will be changed, so that the access port is driven to move downwards.

Accordingly, by disposing two relays, a power-supply device for supplying power to the driving mechanism 400 can output one kind of direct current, without having to configure two kinds of direct current, which has a relatively low demand for the components and is low in cost and convenient to manufacture.

Optionally, maximum one-way time for the driving mechanism 400 to drive the access port to move upwards or downwards is a pre-determined adjustable time. That is, the time for the driving mechanism 400 to drive the access port to move from the non-washing-state position to the washing-state position is a pre-determined adjustable time T, and the time for the driving mechanism 400 to drive the access port to move from the washing-state position to the non-washing-state position is also the pre-determined adjustable time T. Thus, the operation is more convenient, and the times of upward movement and downward movement are same, which is advantageous for the access port to move in place and guarantees the normal operation of the washing machine. The pre-determined adjustable time T may be set flexibly according to specific conditions, and optionally, the pre-determined adjustable time T may be 3 seconds to 20 seconds. For example, the pre-determined adjustable time T may be 5 s, 10 s or 15 s. Thus, the movement time of the access port is suitable and the user may wait for a short time, the operation is convenient, and the washing machine has a good performance.

Furthermore, after the front-loading washing machine is powered and before it operates, the first relay is closed for the pre-determined adjustable time T and the second relay is disconnected; when the front-loading washing machine starts operating, the second relay is closed before the first relay, and the first relay and the second relay may be closed for the pre-determined adjustable time T simultaneously; and when the front-loading washing machine stops operating, the first relay is closed for the pre-determined adjustable time and the second relay is disconnected.

That is, when the front-loading washing machine is powered and before it starts to operate, i.e. when the front-loading washing machine is in a powered standby state, both the first relay and the second relay are in a disconnection state; at this moment, the first relay can be closed on the condition that the second relay keeps disconnected, and when the first relay is closed for the pre-determined adjustable time T, the access port can move to the non-washing-state position and the clothes can be put in through the access port conveniently; after the clothes is put in, a start button is pressed and a door lock is closed to lock the door unit 300, such that the front-loading washing machine starts to operate, and now the second relay may be closed; after the second relay is closed for a period of time, the first relay is closed, and then the first relay and the second relay keep closed for the pre-determined adjustable time T simultaneously, in which case the access port can move to the washing-state position and the front-loading washing machine can start to implement the washing operation; when the washing procedure is finished, the first relay is closed on the condition that the second relay keeps disconnected, and when the first relay is closed for the pre-determined adjustable time T, the access port can move upwards to the non-washing-state position; and after the door is unlocked, the door unit 300 can be opened and the clothes washed can be taken out conveniently.

Accordingly, the access port can move smoothly and reliably, and especially when the access port moves downwards, the second relay is closed before the first relay, which can prevent the access port from being driven to move upwards caused by a late direction change of the direct current when it should move downwards, results in a reliable control and operation, and improve the security of using the front-loading washing machine.

As shown in FIG. 1 to FIG. 3, when the access port is located at the non-washing-state position (as shown in FIG. 3), the access port may move to approach an upper edge of the front panel 110. When the access port is located at the washing-state position (as shown in FIG. 1 and FIG. 2), the access port may move to approach a lower edge of the front panel 110. Hence, when the user needs to put in or take out the clothes, the access port can be moved to approach the upper edge of the front panel 110 to make it convenient for the user to put the clothes in or take them out from above; and when the user needs to wash the clothes, the access port can be moved to approach the lower edge of the front panel 110 to facilitate washing the clothes through rolling of the drum.

As shown in FIG. 1, the front panel 110 can incline backwards from the bottom up, so as to further make it convenient for the user to put the clothes in or take them out when the access port moves to the non-washing-state position.

Advantageously, as shown in FIG. 2 and FIG. 3, the driving mechanism 400 is configured to drive the access port to move upwards to approach the upper edge of the front panel 110 and move downwards to approach the lower edge of the front panel 110. When the user needs to put the clothes in or take them out, the user can operate the driving mechanism 400 to make the access port move upwards to approach the upper edge of the front panel 110, so as to adjust the position of the access port conveniently; and when the user needs to wash the clothes, the user can operate the driving mechanism 400 to make the access port move downwards to approach the lower edge of the front panel 110, so as to facilitate washing the clothes through rolling of the drum.

Optionally, the access port has a range of motion in the opening 111 configured in such a way that an included angle between a central axis of the access port and a horizontal plane is 0 degree to 90 degrees. In other words, the access port can move between a first position where the central axis thereof lies horizontally and a second position where the central axis thereof stands vertically. Specifically, when the access port is located at the non-washing-state position suitable for putting the clothes in or taking them out, the central axis of the access port can be oriented along a vertical direction; and when the access port is located at the washing-state position suitable for washing the clothes, the central axis of the access port can be oriented along a horizontal direction. Thus, it is not only convenient for the user to put in or take out the clothes from above, but also convenient to wash the clothes through rolling of the drum.

Those skilled in the related art should understand that the motion range of the access port can be adjusted according to actual needs. For example, when the access port is located at the non-washing-state position (as shown in FIG. 3), the central axis of the access port can incline forwards from the bottom up, which can also make it convenient for the user to put in or take out the clothes. When the access port is located at the washing-state position (as shown in FIG. 1 and FIG. 2), the central axis of the access port can be oriented at a predetermined angle relative to the horizontal direction on the premise that the clothes in the drum can be washed in a rolling way.

For example, according to some embodiments of the present disclosure, when the front-loading washing machine 1 is in the non-washing-state position, the included angle between the central axis of the access port and the horizontal plane may be 45 degrees to 90 degrees, such as 60 degrees, 70 degrees or 80 degrees. When the front-loading washing machine is in the washing-state position, the included angle between the central axis of the access port and the horizontal plane may be 0 degree to 15 degrees, such as 3 degrees, 7 degrees or 12 degrees. Thus, the front-loading washing machine is more convenient and flexible to use and easy to manufacture, and it is convenient to put clothes in and take clothes out, along with a good washing effect.

As shown in FIG. 1 to FIG. 4, the driving mechanism 400 may include a longitudinal pushrod 410 disposed at a front side of the tub 200, a transverse shaft 420 disposed at a rear side of the tub 200 and coupled with the tub 200, and a support frame 430 disposed to the cabinet 100 and having a hole 431, in which the transverse shaft 420 rotates in the hole 431 of the support frame 430. The tub 200 can be rotatably disposed to the support frame 430 by the transverse shaft 420, to make the access port move up and down in the opening 111; and the tub 200 can be driven to move by the longitudinal pushrod 410, to implement adjustment of the position of the access port.

The longitudinal pushrod 410 can work under the control of the controller, and the power source the longitudinal pushrod 410 needs to move is direct current. A movement rod of the longitudinal pushrod 410 may push outwards at a uniform speed after powered on, in which case the longitudinal pushrod 410 pushes the tub 200 upwards, and when the tub 200 rises to the highest position, i.e. the access port moves upwards to the non-washing-state position, the longitudinal pushrod 410 may trigger a position limiting switch of the controller and the controller controls the longitudinal pushrod 410 to stop moving; if the positive and negative poles of the direct current are exchanged, the movement rod of the longitudinal pushrod 410 will pull backwards, in which case the longitudinal pushrod 410 pulls the tub 200 downwards, and when the tub 200 is pulled to the lowest position i.e. the access port moves downwards to the washing-state position, the longitudinal pushrod 410 may trigger the position limiting switch and the longitudinal pushrod 410 stops moving.

Figure 4:
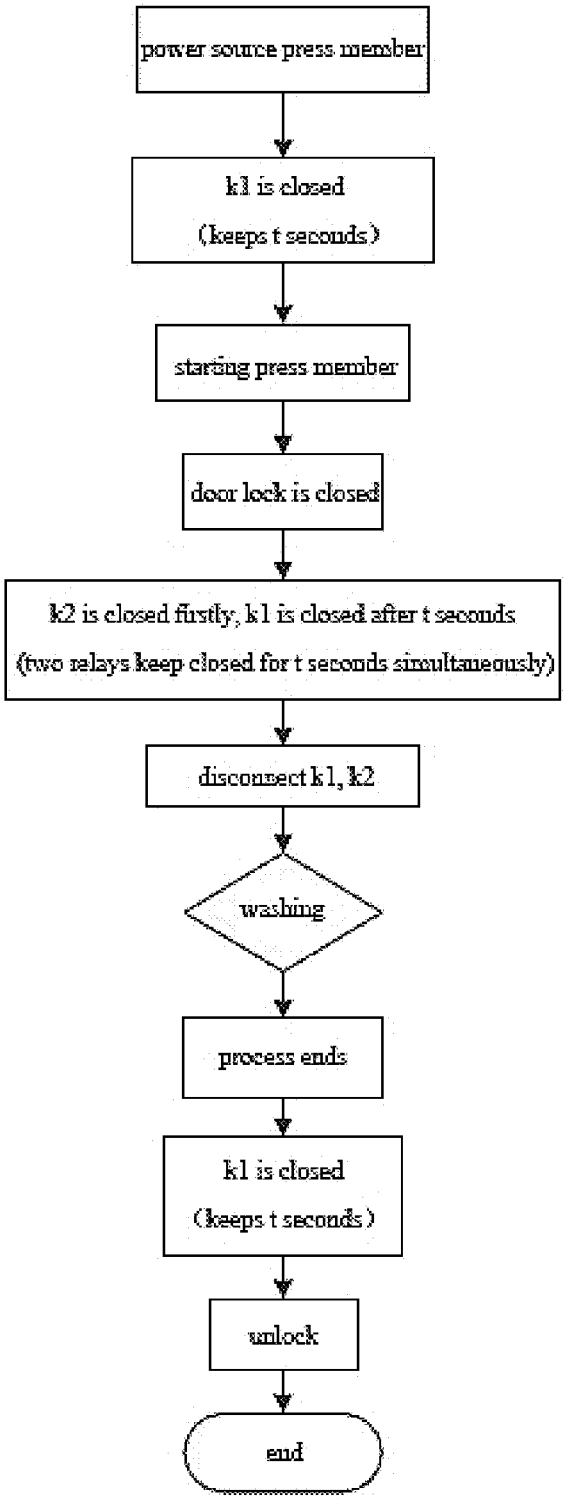
FIG. 4 is a control flow chart of the front-loading washing machine according to the embodiment of the present disclosure.

The controller may be a computer board assembly, and the computer board assembly includes two relays: the first relay and the second relay, through which the longitudinal pushrod 410 is controlled. The first relay controls conduction and turn-off of the power source input to the longitudinal pushrod 410, and the second relay controls the positive and negative of the power source input to the longitudinal pushrod 410. In FIG. 4, for the convenience of description, the first relay is indicated by K1, and the second relay is indicated by K2. When the first relay is closed and the second relay is disconnected, the longitudinal pushrod 410 pushes outwards i.e. pushes upwards; and when the first relay is closed and the second relay is closed, the longitudinal pushrod 410 pulls backwards. The power source line of the front-loading washing machine 1 is plugged into a socket to be powered on; a power button is pressed; the controller controls the first relay to close for the pre-determined adjustable time T, and the longitudinal pushrod 410 is in a pushing-outwards state and keeps inclined upward at a certain degree before the machine starts operating.

As shown in FIG. 4, the start button is pressed and the door lock is closed. The controller firstly controls the second relay to be closed for a period of time t to complete direction change, in which the closure time t may be set according to practical demands, for example 5 s or less. The first relay is then closed and the two relays keep closed for the pre-determined adjustable time T simultaneously. The longitudinal pushrod 410 is powered on and can pull backwards at a uniform speed, such that the tub 200 can be pulled to a first angle by the longitudinal pushrod 410, and when the access port move downwards to the washing-state position, the machine starts the normal operation process. When the normal operation process ends, the drum stops rolling, the first relay is closed for the pre-determined adjustable time T, such that the longitudinal pushrod 410 pushes outwards i.e. pushes upwards, and when it moves upward to a certain degree, the access port moves upwards to the non-washing-state position, i.e. the door is unlocked and the whole process ends after the longitudinal pushrod 410 stops moving.

Other configurations and operation of the front-loading washing machine 1 according to embodiments of the present disclosure are known for those skilled in the art, which will not be described in detail herein.

In the specification, it is to be understood that terms such as "center," "upper," "lower," "front," "rear," "left," "right," "vertical," "horizontal," "top," "bottom," "inner", "outer" and "axial," should be construed to refer to the orientation as then described or as shown in the drawings under discussion. These relative terms are for convenience of description and do not require that the device or element be constructed or operated in a particular orientation, shall not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections or be communicated with each other; may also be direct connections or indirect connections via intervening structures; may also be inner communications or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an intervening structures.

Reference throughout this specification to "an embodiment," "specific embodiments," "an example," or "a specific example," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Furthermore, different embodiments or examples in thus specification can be jointed and combined by those skilled in the art without mutual contradiction.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A front-loading washing machine, comprising:

a cabinet having a front panel, wherein the front panel is provided with an opening;

a tub having an access port for loading and unloading laundry, wherein the tub is disposed in the cabinet, and configured in such a manner that the access port is capable of being moved up and down in the opening, the tub having a rear edge opposite the access port, an upper side, and a lower side opposite the upper side;

a rotatable drum disposed in the tub;

a door unit mounted to the tub, and covering the access port;

a driving mechanism configured to drive the tub to rotate, wherein the driving mechanism is provided in the cabinet and coupled with the tub, and the driving mechanism comprises:

a longitudinal pushrod with a first end disposed at a front side of the tub;

a transverse shaft disposed proximate to the rear edge and the lower side of the tub and coupled with the tub; and a support frame comprising two longitudinal brackets and a transverse bracket, wherein the two longitudinal brackets are spaced apart from each other, the transverse bracket has two ends connected with the two longitudinal brackets respectively, the support frame connected to the cabinet and having a hole, the transverse bracket receiving a second end of the drive mechanism;

wherein the transverse shaft is configured to rotate in the hole of the support frame; and a controller communicating with the driving mechanism, wherein when the front-loading washing machine starts a washing cycle, the controller controls the driving mechanism to drive the access port to move downwards, and wherein when the front-loading washing machine stops the washing cycle, the controller controls the driving mechanism to drive the access port to move upwards;

wherein the controller controls the driving mechanism to drive the access port to move upwards or downwards by controlling polarity of a direct current input to the driving mechanism; and wherein the controller comprises a first relay and a second relay, the first relay being configured to control an on-off state of the direct current input to the driving mechanism, and the second relay being configured to control the polarity of the direct current input to the driving mechanism;

wherein the support frame, the tub, and the driving mechanism are dampened relative to the cabinet by a damping vibration absorption mount comprised of a plurality of dampers that connect the support frame to the cabinet.

2. The front-loading washing machine according to claim 1, wherein the driving mechanism is configured to drive the access port to move up and down between a non-washing-state position and a washing-state position in the opening.

3. The front-loading washing machine according to claim 2, wherein when the access port is located at the non-washing-state position, the access port is driven to move close to an upper edge of the front panel; and when the access port is located at the washing-state position, the access port is driven to move close to a lower edge of the front panel.

4. The front-loading washing machine according to claim 2, wherein when the access port is located at the non-washing-state position, an included angle between a central axis of the access port and a horizontal plane is 45 degrees to 90 degrees; and when the access port is located at the washing-state position, the included angle between the central axis of the access port and the horizontal plane is 0 degree to 15 degrees.

5. The front-loading washing machine according to claim 1, wherein the driving mechanism is configured to drive the access port to move upwards to approach the upper edge of the front panel and move downwards to approach the lower edge of the front panel.

6. The front-loading washing machine according to claim 1, wherein when the first relay is closed and the second relay is open, the driving mechanism drives the access port to move upwards; and when the first relay is closed and the second relay is closed, the driving mechanism drives the access port to move downwards.

7. The front-loading washing machine according to claim 6, wherein a maximum one-way time for the driving mechanism to drive the access port to move upwards or downwards is a pre-determined adjustable time.

8. The front-loading washing machine according to claim 7, wherein after the front-loading washing machine is powered and before the washing cycle starts, the first relay is closed for the pre-determined adjustable time and the second relay is open; when the front-loading washing machine starts the washing cycle, the second relay is closed before the first relay, and the first relay and the second relay are closed for the pre-determined adjustable time simultaneously once the first relay is closed; and when the washing cycle is finished, the first relay is closed for the pre-determined adjustable time and the second relay is open.

* * * * *